United States Patent [19]

Berkebile et al.

[11] 4,245,218

[45] Jan. 13, 1981

[54] FOOT ALARM FOR RUNNERS

[76] Inventors: Linda F. Berkebile; Robert J. Berkebile, both of 8309 Old Harford Rd., Baltimore, Md. 21234

[21] Appl. No.: 111,120

[22] Filed: Jan. 10, 1980

[51] Int. Cl.[3] ..... G08B 15/00

[52] U.S. Cl. ..... 340/574; 200/DIG. 2; 340/693

[58] Field of Search ..... 340/574, 693; 200/DIG. 2

[56] References Cited

U.S. PATENT DOCUMENTS

| | | | |
|---|---|---|---|
| 477,940 | 6/1892 | Hurd . | |
| 568,532 | 9/1896 | Hauser . | |
| 3,226,705 | 12/1965 | Kaufman et al. | |
| 3,248,723 | 4/1966 | Miethe . | |
| 3,614,763 | 10/1971 | Yannuzzi . | |
| 3,702,999 | 11/1972 | Grandisar . | |
| 3,777,086 | 12/1973 | Riedo . | |
| 3,825,833 | 7/1974 | Bogue et al. | 340/574 |
| 4,080,595 | 3/1978 | Rosen . | |
| 4,121,160 | 10/1978 | Cataldo . | |

*Primary Examiner*—Glen R. Swann, III

*Attorney, Agent, or Firm*—John F. McCLellan, Sr.

[57] ABSTRACT

A personal alarm for runners includes a shoe-mounted sounding mechanism positionable out of the way in running but for actuation by a kick with either foot to depress a switch plunger against the off foot, or actuation by a kick against the ground, an attacker or other object; a key-shut-off provision insures prolongation of the alarm when sounded; an adjustable provision for mounting to a shoe of any size in optimum position and quick detachment/attachment includes a lace-mounted pad with hook-and-loop fabric attachment to the bottom of the case of the sounding mechanism; and the interior of the case displays indentifying indicia for the runner through a transparent dome which waterproofs the case and which shows precisely the location of the switch.

13 Claims, 4 Drawing Figures

FOOT ALARM FOR RUNNERS

BACKGROUND OF THE INVENTION

This invention relates to signalling systems generally and particularly to an audible alarm for use on the person.

A problem faced by many runners at one time or another and especially by women joggers is the possibility of attack, particularly at night, which is the only time many people can run.

When attacked, the victim may be within sight or sound of others until thrown down and when thrown down usually cannot reach freely to sound an alarm if one is carried on the person.

Alarms which are or could be carried on the person are known, as evidenced in the prior art by the following U.S. Pat. Nos.

4,121,160 to T. R. Cataldo, Oct. 17, 1978, discloses a miniature radio alarm transmitter which has a switch button;

4,080,595 to L. J. Rosen, Mar. 21, 1978, discloses a miniature battery powered audible alarm which has a switch contact movable by a button;

3,777,086 to O. Riedo, Dec. 5, 1972, discloses a shoe mounted alarm system in which the toe actuates the switch within the shoe, sounding an alarm at a remote location;

3,702,999 to I. A. Grandisar, Nov. 14, 1972, discloses another form of shoe mounted warning system; this signals excess weight;

3,614,763 to A. Yannuzzi, Oct. 19, 1971, discloses an electric audible alarm for personal use actuated when the wearer falls to the ground;

3,248,723 to K. H. Miethe, Apr. 26, 1966, discloses a wearable flashlight type alarm sounder with mercury switch control;

3,226,705 to P. Kaufman er al, Dec. 28, 1965, discloses a battery powered intruder alarm;

568,532 to I. L. Hauser, Sept. 29, 1896, discloses a mechanical alarm of small size, and 477,940 to J. F. Hurd, June 23, 1892, discloses an electric pickpocket alarm.

SUMMARY OF THE INVENTION

However, none of these disclosures nor any other known is believed to provide all the advantages of the present invention according to the objects set out below.

Principal objects of this invention are to provide an alarm system, particularly suited for runners, which can be set off by kicking and which gives visible evidence that the runner is wearing an alarm but is difficult for an attacker to foil.

Another object is to provide an alarm with attachment adjustably locatable at a part of the foot which minimizes interference with running and which is optimally located for kicking.

Further objects are to provide an audible alarm which has attachment which will adjust to any size lace-type shoes and which may be quickly detached and re-attached when desired, as when changing shoes.

Still further objects are to provide an alarm as described which is difficult to set off accidentally, which is watertight, which provides means for identification of the wearer, which is distinctive and attractive in appearance, and which is not likely to be inadvertently forgotten and left behind by a runner.

In brief summary given for cursive description purposes only and not as limitation the invention includes an audible alarm with means for kicking it to sound the alarm and attachment adjustable to fit on any size and type lace-secured show at a position of least interference with running.

BRIEF DESCRIPTION OF THE DRAWING

The above and other objects and advantages of this invention will become more readily apparent on examination of the following description, including the drawings, in which like reference numerals refer to like parts.

DESCRIPTION OF THE PREFERRED EMBODIMENT

Figure 1:
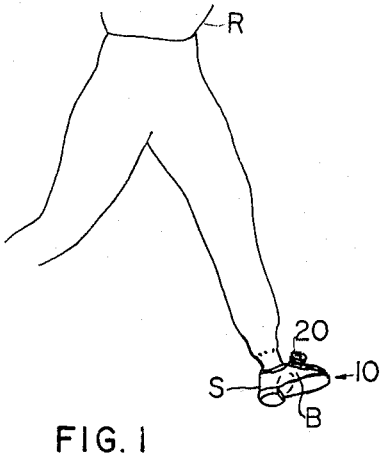
FIG. 1 is a persepective view of the invention in use.

FIG. 1 shows the invention or audible alarm 10 in use attached to the shoe S of a runner R, adjustably secured in position over the tarsal arch or bridge B of the foot where it interferes very little or not at all with running for most people.

In this position, however, the audible alarm can conveniently and instantly be actuated by kicking downward on switch arm 20 with the off-foot, or kicking the switch arm against the off-foot, in case of need, either while running or on the ground. Further, when on the stomach the user can kick the switch against the ground to actuate the alarm. Kicking an attacker, while the user is standing or when on the ground can also actuate the switch.

As will be seen, once the alarm is activated it continues to sound until stopped by key access to the interior, in an unobvious way and location, convenient, however, to the user.

The highly visible location serves to forewarn attackers that the user is protected, and to further this the alarm preferably has an electric-blue color with the switch, which is visible, a bright yellow.

Figure 2:
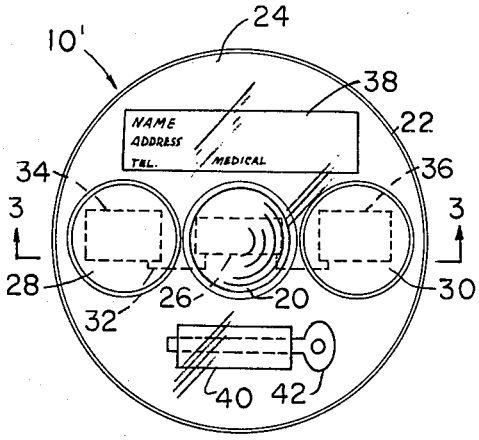
FIG. 2 is a front elevational detail or face view.

FIG. 2 shows the face view of the alarm portion 10' of the invention. Housing or case 22 preferably is circular to prevent snagging of apparel and has a transparent dome-like circular top 24. The transparent circular top is of flexible clear plastic such as "Mylar" and may be for the purpose conventionally about ten one-thousandths of an inch (0.25 mm) thick.

Switch arm 20 is centered under the top in position to be depressed (arrow) by a kick with either foot and actuate the alarm system through depressable switch 26 which is located for projecting the switch arm outwardly substantially perpendicular to the bridge of a runner's foot.

To either side of the switch may be a sounder 28, 30 having connection 32 for actuation through the switch to battery powered supply 34, 36.

This showing is schematic and conventional. The type sounding means disclosed in U.S. Pat. No. 4,080,595, which discloses battery and switch for connecting it with a buzzer alarm, or in U.S. Pat. No. 3,614,763 discloses a switch-actuable electronic audio signal generator incorporating a miniature integrated circuit permitting the device to be housed within a small and inconspicuous package, may be used, for example.

At the top of the face an identification plate 38, contains name, address and telephone number of the user and at the bottom tape 40 detachably secures a key 42 to shut off the sounding system when energized.

Figure 3:
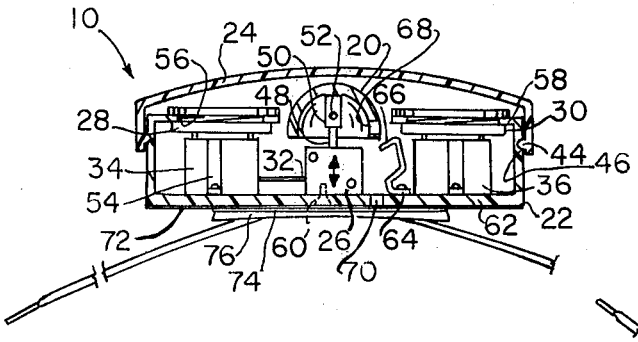
FIG. 3 is a side elevational detail in partial section; adapted from 3—3, FIG. 2.

FIG. 3 shows a sectional detail of the invention 10 adapted from 3—3, FIG. 2.

The dome on top 24 may have a circumferential bead 44 which makes a dust and water proof seal in a groove 46 around the housing 22. The dome can be removed for access to the portions visible through it.

The switch arm 20 may have the form of a mushroom shaped cap closely fitted, and may connect to the switch stem 48 by a sleeve portion 50 and set-screw 52. The supplies 34, 36 may connect to the sounders by straps 54 for securance.

The sounders may have screw connection 56 to the top plate 58 of the housing and the switch 26 may have screw connection 60 to the bottom 62 of the housing.

As noted, a feature of the invention is the latch-on nature of the signalling system preventing shutting off by hand manipulation and requiring the key for shutting off. This feature may be of any conventional design, integral with the switch or as shown here diagrammatically, a flat spring 64 secured to the bottom or base 62 of the housing, with an upward portion extending a downturned end forming a hook 66 into the path of the switch arm, which may have a recess 68 engageable by the hook when the switch is depressed to hold it there.

A key-hole 70 in the back permits a slender rod-shaped key to be thrust against the flat spring to release the hook.

The housing 22 may be a unitary cup, sealed on the bottom by a double-face pressure sensitive adhesive tape layer 72 which also serves to attach permantently a layer of "Velcro" wool 74 to the bottom of the housing.

The "Velcro" wool detachably secures to a piece of "Velcro" hook material 76 carried as a pad held to the user's shoe by shoestrings threaded through the pad.

Figure 4:
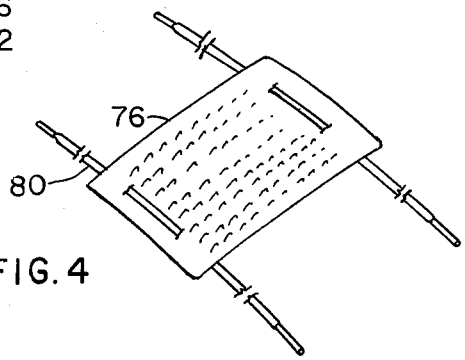
FIG. 4 is a perspective detail showing attachment portions of the invention.

FIG. 4 details the relation of the "Velcro" hook material 76, and attachment strings 80 threaded through it. The attachment strings preferably are shoestrings about 14 inches (35 cm) long, so that they can adjustably be threaded through the strings on the user's shoes. This provides up-and-down-the-foot adjustment. Side-to-side adjustment is provided by means of offsetting the engagement of the "Velcro" wool with the "Velcro" hooks.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. An alarm system for runners wearing shoes comprising: sounding means, means for detachably attaching the sounding means to a said runner's shoe over the bridge of said runner's foot, and means for actuating the sounding means by a kick of either foot of said runner.

2. An alarm system as recited in claim 1, and means preventing shutting off the alarm system by hand manipulation.

3. An alarm system as recited in claim 2, the means for actuating comprising a depressable switch located for projecting outwardly substantially perpendicular to the bridge of a runner's foot.

4. An alarm system as recited in claim 3, further comprising means waterproofing said sounding means and switch including an enclosing case with an open upper portion, and a dome closing the upper portion of the case.

5. An alarm system as recited in claim 4, the dome being sufficiently flexible for yielding under the force of a said kick and depressing the switch.

6. An alarm system as recited in claim 5, the dome being transparent, and runner-identification means within the dome and visible through the dome.

7. An alarm system as recited in claim 6, the means for preventing comprising means holding the switch depressed, a key, and the case having a bottom with a hole located for key access therethrough for releasing the switch from the holding means.

8. An alarm system as recited in claim 7, the dome having detachable attachment to the case, and the key having detachable attachment to the case within the dome.

9. An alarm system as recited in claim 1, the means for detachably attaching the sounding means to a runner's foot including means for adjusting the sounding means up and down a runner's foot and to fit various sizes of shoe.

10. An alarm system as recited in claim 9, the means for adjusting the sounding means up and down a runner's foot and to fit various sizes of shoe including a pad, and the pad having means for lacing to the type runner's shoe having shoestrings.

11. An alarm system as recited in claim 10, the means for lacing including first and second laces running through and extending from said pad.

12. An alarm system as recited in claim 10, the means for detachably attaching the sounding means to a runner's foot including a case containing the sounding means, the case having a bottom, and complementary hook-and-loop type fastening means respectively on the case bottom and the pad.

13. An alarm system as recited in claim 12, and means providing for adjusting the case from side to side on a runner's foot, comprising one of said case bottom and pad having a greater side-to-side extent of said fastening means than the other of said case bottom and pad.

* * * * *